United States Patent [19]

Means

[11] 4,091,484

[45] May 30, 1978

[54] COLLAPSIBLE BOAT CANOPY AND STORAGE COMPARTMENT THEREFOR

[75] Inventor: John R. Means, Paso Robles, Calif.

[73] Assignee: Porter, Inc., Decatur, Ind.

[21] Appl. No.: 811,687

[22] Filed: Jun. 30, 1977

[51] Int. Cl.[2] ..... B63B 17/02

[52] U.S. Cl. ..... 9/1.5; 135/6; 296/136

[58] Field of Search ..... 9/1.5; 114/71; 296/116, 296/107, 109, 110, 118, 123, 136; 135/6

[56] References Cited

U.S. PATENT DOCUMENTS

| | | | |
|---|---|---|---|
| 1,071,348 | 8/1913 | Rice | 296/136 |
| 3,367,349 | 2/1968 | O'Link | 135/6 |
| 3,823,431 | 7/1974 | Miller | 135/6 |

*Primary Examiner*—Trygve M. Blix
*Assistant Examiner*—D. W. Keen
*Attorney, Agent, or Firm*—Gust, Irish, Jeffers & Rickert

[57] ABSTRACT

A storage compartment for a collapsible boat canopy which folds to a horizontal position within the rear portion of the cockpit when not in use. The storage compartment is formed underneath the rear deck of the boat and has a forwardly facing opening closed by means of the rear passenger seat backrest, which is hingedly connected to the leading edge of the rear deck. The structural members for the canopy are supported within tracks on the cockpit side walls thereby permitting the entire canopy structure to be slid rearwardly so that the folded fabric portion is received within the storage compartment. The rear seat backrest is then swung downwardly over the opening and all but the vertical legs of the canopy structure is concealed. An upstanding ridge molded into the floor of the storage compartment serves to prevent the canopy from sliding forwardly.

8 Claims, 7 Drawing Figures

FIG. 4
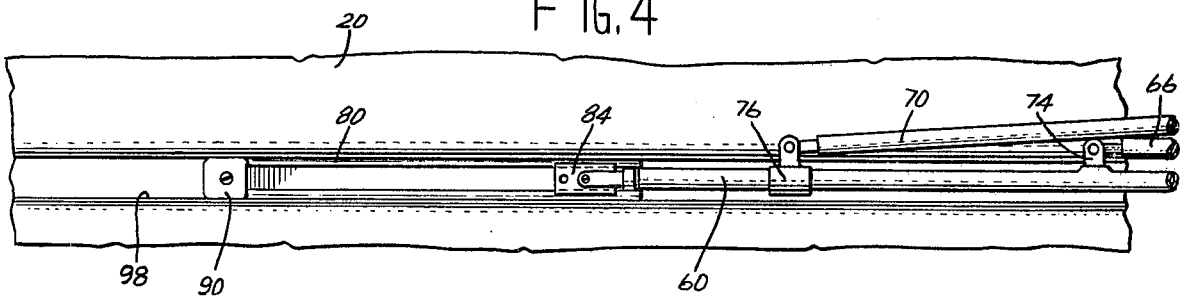
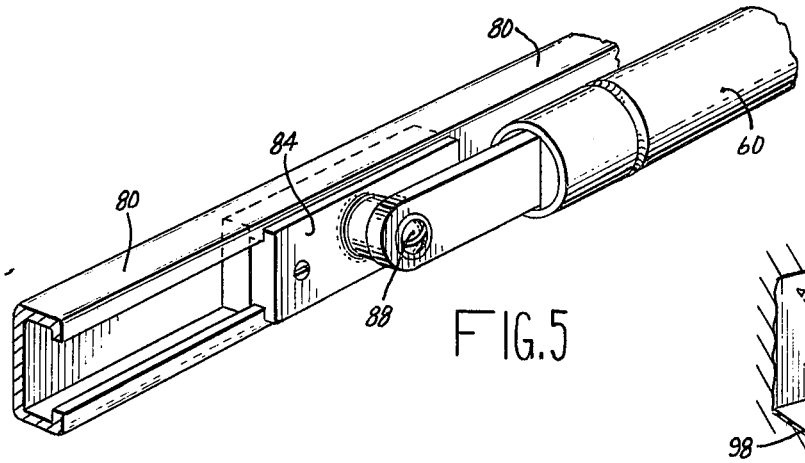
FIG. 5
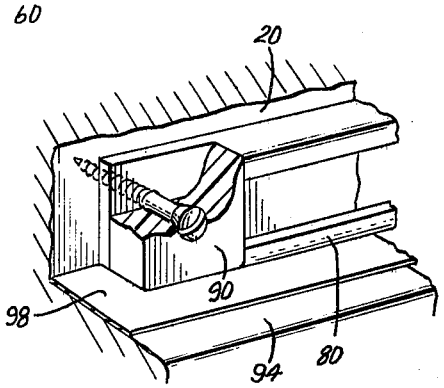
FIG. 6
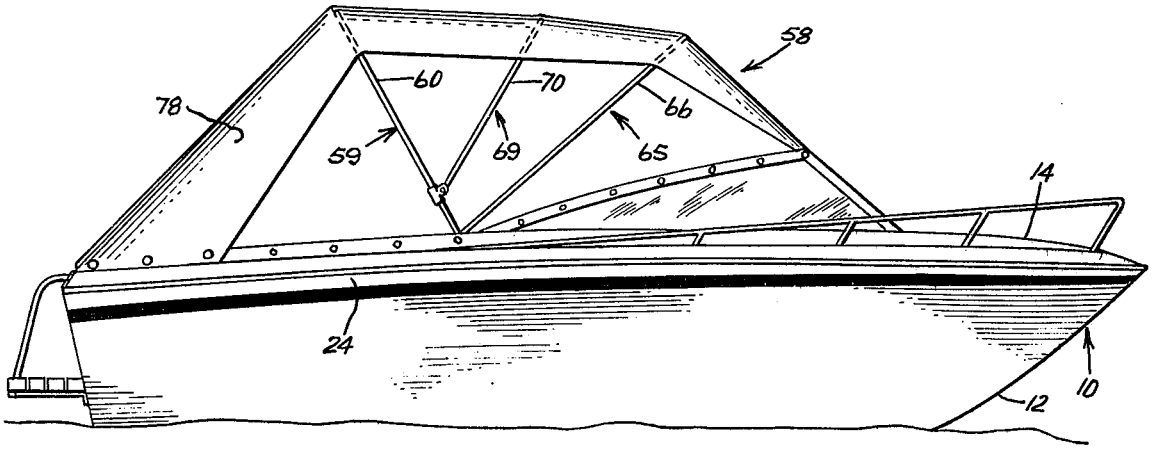
FIG. 7

COLLAPSIBLE BOAT CANOPY AND STORAGE COMPARTMENT THEREFOR

BACKGROUND OF THE INVENTION

The present invention relates to means for stowing collapsible boat canopies, and in particular to a rear deck storage compartment for a boat canopy whose structural members are spported within horizontal tracks on the interior side walls of the boat cockpit.

Many pleasure boats today carry as standard or optional equipment a collapsible canopy which may be folded to a storage position when not in use. One such canopy comprises a plurality of pivotally interconnected U-shaped structural members which are supported by horizontal tracks on the interior side walls of the cockpit. When folded, the canopy assumes a horizontal position and is generally supported on horizontal ledges on the cockpit side walls beneath and extendng parallel to the tracks.

In one prior art arrangement, a collapsible canopy of this type is stored within a compartment beneath the rear deck of the boat immediately aft of the rear passenger seat. A portion of the rear deck forms a hinged top for the compartment so that when it is opened, the folded fabric portion of the canopy may be dropped therein. The vertical leg portions of the structural members extend forwardly on either side of the rear passenger seat to the point where they are connected to the horizontal supporting tracks.

A disadvantage to this structure is that the rear deck is not rigid. Since it is often stepped on by passengers when boarding and unboarding, it must be capable of supporting a considerable amount of weight. This tends to stress the hinges and may lead to undue wear or collapse of the rear deck. Furthermore, the bouncing movement of the boat as it traverses rough water may cause the storage compartment lid to open accidentally unless it is latched down.

SUMMARY OF THE INVENTION

The present invention overcomes the disadvantages of the prior art apparatus discussed above by providing a storage compartment beneath the rear deck to which access is provided by means of a forwardly facing opening over which the hinged rear passenger seat drops. This enables the rear deck to be rigid thereby resulting in an overall structure having increased strength and durability.

Specifically, the present invention contemplates a collapsible canopy and storage compartment for a boat having an open cockpit and rear deck which comprises a compartment underneath the rear deck having a forwardly facing opening, a collapsible canopy which is foldable to a general horizontal position, means attaching the canopy to the boat whereby the canopy can be slid rearwardly through the opening at least partially into the compartment, a passenger seat immediately forward of the rear deck having a generally vertical backrest which closes the compartment opening, and means connecting the backrest to the boat for movement between open and closed positions with respect to the compartment opening.

It is an object of the present invention to provide a collapsible boat canopy and storage compartment therefor wherein the canopy is stowed beneath the rear deck through a forwardly facing access opening behind the rear passenger seat.

It is also an object of the present invention to provide a storage compartment for a collapsible boat canopy underneath a rear deck which is rigid, thereby resulting in a construction having greater overall strength and providing increased support for vertical loads.

Another object of the present invention is to provide a storage compartment for a collapsible boat canopy wherein the rear deck is devoid of joints and hinges.

Yet another object of the present invention is to provide means whereby a collapsible boat canopy may be rapidly and conveniently stowed.

These and other objects and features of the present invention will become more apparent from a reading of the following description taken together with the accompanying drawings.

BRIEF DESCRIPTION OF THE DRAWINGS

FIG. 4 is a side elevational view showing a portion of the canopy structural members and one of the supporting tracks;

FIG. 5 is an enlarged, fragmentary perspective view showing the details of one of the canopy slides;

FIG. 6 is an enlarged, fragmentary perspective view of the forward end of one of the canopy supporting tracks; and FIG. 7 is a side elevational view of a boat having a canopy of the type described herein in its raised position.

DESCRIPTION OF THE PREFERRED EMBODIMENT

Figure 1:
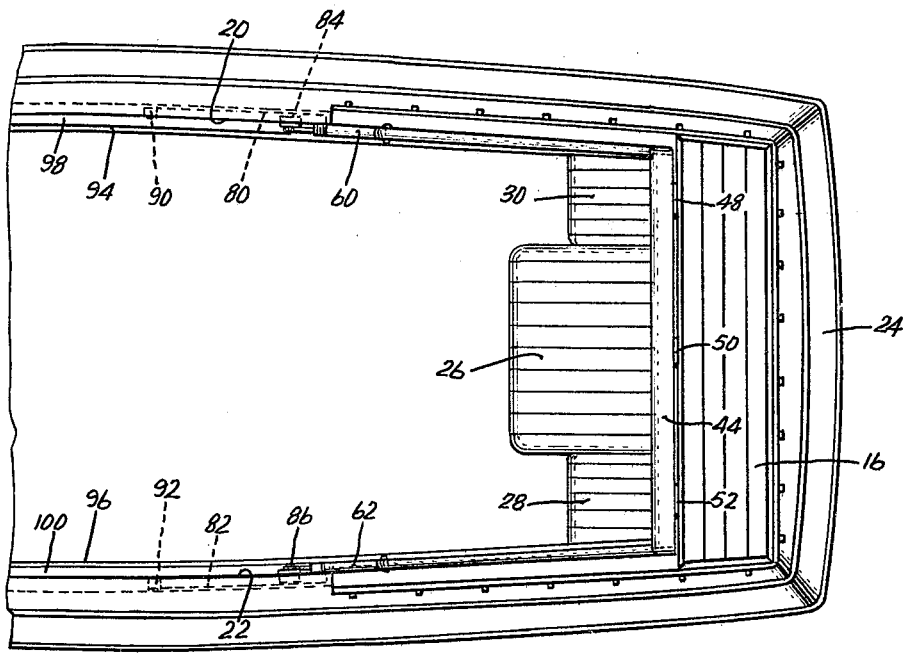
FIG. 1 is a fragmentary top plan view of a boat provided with a canopy and storage compartment according to the present invention wherein the canopy is stowed beneath the rear deck and the rear passenger seat backrest has been folded down to its normal position.

With reference to the drawings, the canopy and storage compartment of the present invention are shown incorporated in a standard runabout 10 having a hull 12, forward deck 14, rear deck 16 and a cockpit 18 having side walls 20 and 22. Customarily, a boat of this type is made of molded fiberglass and the decks 14 and 16 may either be either molded integrally therewith or formed separately. In the present embodiment, rear deck 16 is made of a waterresistant wood such as teak, and is of solid, rigid construction. It is rigidly secured to the peripheral deck 24.

The boat 10 is also provided with an engine enclosure 26 and a pair of rear passenger seats 28 and 30, all of which are padded so as to provide comfort to the passengers. A storage compartment 32 is formed beneath rear deck 16 and comprises a shelf having a bottom 34, rear wall 36 and side walls 38 and 40. Compartment 32 may be molded integrally with deck 24 and joined with rear deck 16. An upstanding ridge 42 is formed integrally with bottom 34 and, as shown in FIGS. 2 and 3, terminates short of compartment sides 38 and 40. A backrest 44 is provided for seats 28 and 30 and is pivotally connected to the leading edge 46 of rear deck 16 by hinges 48, 50 and 52. Backrest 44 is contoured such that when it is dropped to its closed position (FIG. 1), it fits around engine enclosure 26 and covers the forwardly facing opening of compartment 32 bordered by the leading edge 46 of rear deck 16, the front edge 54 of compartment bottom 34 and sides 38 and 40. Backrest 44 includes a cutout portion 56 on either side so as to provide clearance for the canopy 58 when it is stowed.

Canopy 58 comprises a first U-shaped structural member 59 having side leg portions 60 and 62 and top portion 64, a second structural member 65 having side leg portions 66 and top portion 68, and a third structural member 69 having side leg portions 70 and a top portion 72. The side legs 66 of the second structural member 65 are respectively pivotally secured to the side legs 60 and 62 of the first member 59 by stationary pivots 74, and the side legs 70 of the third structural member 69 are secured to side legs 60 ad 62 of the first member 59 by sliding pivots 76. A suitably contoured fabric top 78 is secured to structural members 59, 65 and 69 and when the assembly is pulled forward, top 78 is stretched out and assumes the configuration illustrated in FIG. 7.

A pair of horizontal tracks 80 and 82 are secured to opposite sides 20 and 22 of cockpit 18 and slides 84 and 86 are received therein. Side legs 60 and 62 of structural member 59 are pivotally secured to slides 84 and 86, respectively, as by pins 88 (FIG. 5). Stop blocks 90 and 92 are fastened to cockpit sides 20 and 22 and serve to prevent slides 84 and 86 from sliding out of tracks 80 and 82. Ledges 94 and 96, which may be covered with plastic strips 98 and 100, are provided beneath tracks 80 and 82, and serve to support the canopy 58 when it is folded to its horizontal position for storage.

It should be noted that the present invention is not limited to the particular canopy and sliding track arrangement, which are conventional, described above. Obviously, the particular canopy which is employed will depend upon the style and intended use of the boat in question.

Figure 2:
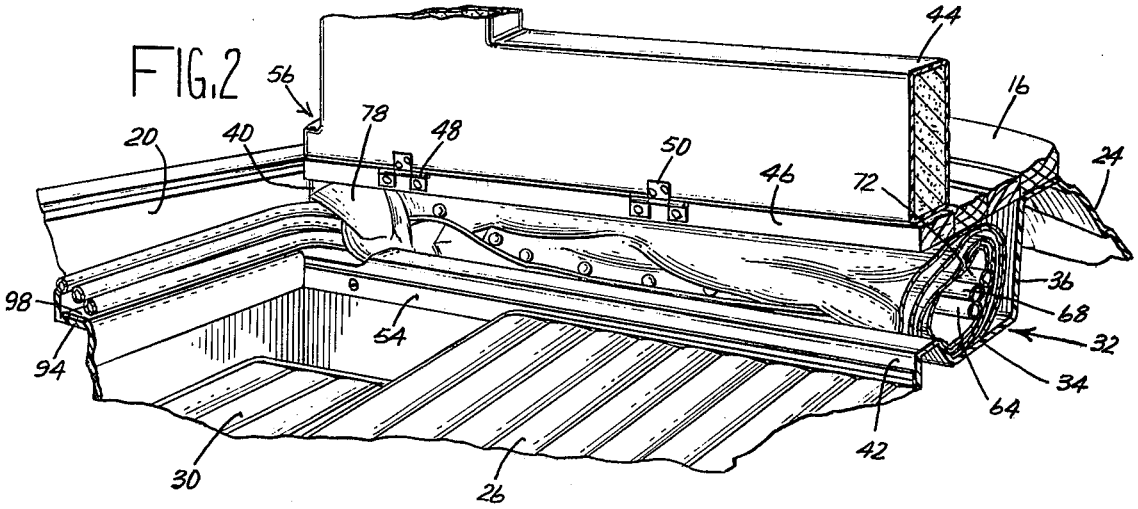
FIG. 2 is a fragmentary perspective view of the storage compartment with the folded canopy stowed therein, and the backrest raised.
Figure 3:
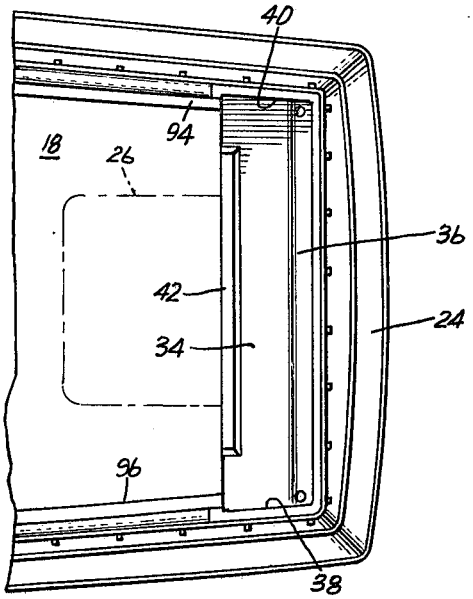
FIG. 3 is a fragmentary top plan view similar to FIG. 1 showing the storage shelf for the canopy wherein the rear deck, seat, engine housing and canopy have been removed.

To store the canopy 58, it is first folded to a horizontal position as shown in FIGS. 1, 2 and 4. Backrest 44 is then raised to the position illustrated in FIG. 2 and canopy 58 is slid rearwardly over ridge 42 into compartment 32. Backrest 44 is then dropped to its lower vertical use position as shown in FIG. 1. It will be noted that the cut out portions 56 on either end of backrest 44 provide clearance for structural members 59, 65 and 69.

To raise the canopy 58, backrest 44 is raised, canopy 58 is lifted above ridge 42 and slid forwardly and the entire canopy assembly is pulled upward and forward to the position illustrated in FIG. 7. Backrest 44 may then be dropped to its use position in front of the storage compartment opening.

While there have been described above the principles of this invention in connection with specific appratus, it is to be clearly understood that this description is made only by way of example and not as a limitation to the scope of the invention.

What is claimed is:

1. In a boat having an open cockpit and a rear deck, the combination comprising:

a compartment underneath said rear deck having a forwardly facing opening, a collapsible canopy being foldable to a generally horizontal position, means attaching said canopy to the boat whereby said canopy may be slid rearwardly through said opening at least partially into said compartment, a passenger seat immediately forward of said rear deck having a generally vertical backrest, said backrest closing said compartment opening, means connecting said backrest to the boat for movement between open and closed positions with respect to said compartment opening, said rear deck including a top leading edge and said connecting means including said backrest being hingedly connected to said edge for pivotal movement about a horizontal axis.

2. The combination of claim 1 wherein said compartment includes a floor and means comprising an upwardly extending stop element on said floor for restraining said canopy from sliding forwardly when stowed in said compartment, said compartment opening being between said stop element and said rear deck.

3. The combination of claim 2 wherein said stop element comprises a ridge extending transversely within said compartment and being spaced from said side walls.

4. The combination of claim 1 wherein said compartment includes a solid floor and means comprising an upwardly extending stop element on said floor for restraining said canopy from sliding forwardly when stowed in said compartment, said compartment opening being between said stop element and said rear deck.

5. The combination of claim 1 including said rear deck which is fixedly mounted in position.

6. The combination of claim 1 including a boat hull and said rear deck which is fixedly mounted on the stern portion of said hull.

7. The combination of claim 6 wherein said compartment includes a horizontal solid floor, an upstanding solid rear wall connected to and extending from an edge of said floor, and a horizontal deck portion connected to the upper edge of said rear wall and extending rearwardly thereof, said rear deck being fixedly superposed on said horizontal deck portion and extending forwardly over said floor in vertically spaced relation therefrom.

8. The combination of claim 7 including a stop element on said floor for restraining said canopy from sliding forwardly when stowed in said compartment, said stop element including an upstanding ridge extending transversely within said compartment and being spaced from said side walls.

* * * * *